United States Patent [19]

Frenette

[11] Patent Number: 4,499,913

[45] Date of Patent: Feb. 19, 1985

[54] METHOD AND APPARATUS FOR PRODUCING FRICTION HEAT

[75] Inventor: Eugene J. Frenette, Derry, N.H.

[73] Assignee: Albert Frenette, Derry, N.H.

[21] Appl. No.: 132,316

[22] Filed: Mar. 20, 1980

[51] Int. Cl.[3] ..... F24C 9/00

[52] U.S. Cl. ..... 126/247

[58] Field of Search ..... 126/247; 122/26; 237/12.1; 290/2

[56] References Cited

U.S. PATENT DOCUMENTS

| | | | |
|---|---|---|---|
| 1,228,215 | 5/1917 | Junkers | 122/26 |
| 4,143,639 | 3/1979 | Frenette | 126/247 |
| 4,365,614 | 12/1982 | Grover | 122/26 X |

*Primary Examiner*—Randall L. Green

*Attorney, Agent, or Firm*—Pearson & Pearson

[57] ABSTRACT

A friction heater having a heat insulative housing containing inner and outer members with at least one member mounted for rotation relative to the other on a common vertical axis, causes oil to rise up into an annular liquid chamber between the members during rotation to generate friction heat. The inner and outer members are of heavy heat conductive material and are of cup shaped configuration, preferably inverted, to receive the electric motor drive in the resulting, central axially extending space. The outer member has an inner side wall within the cup shaped inner member and the housing has an inner side wall within the members to guide air in a flow path over the motor.

1 Claim, 7 Drawing Figures

Fig. 5
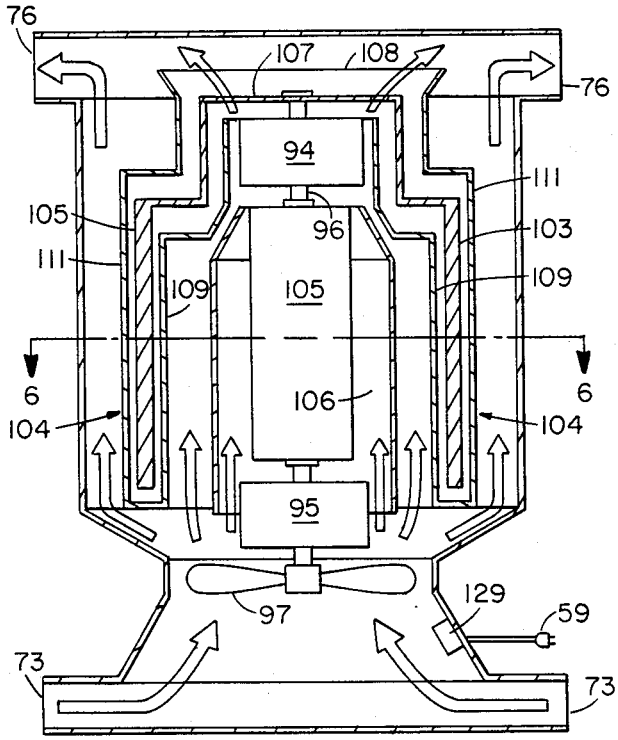
Fig. 6
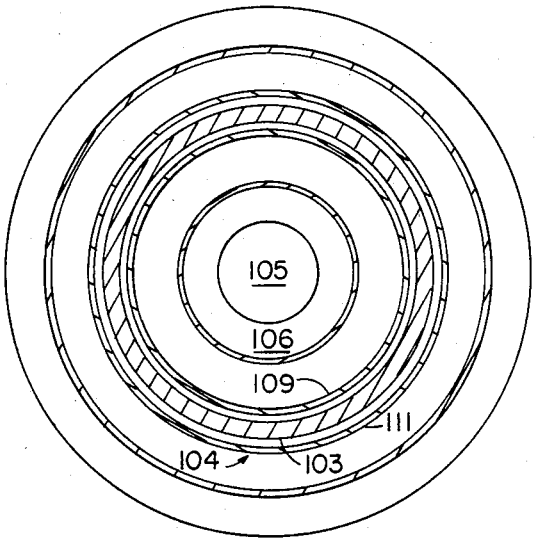
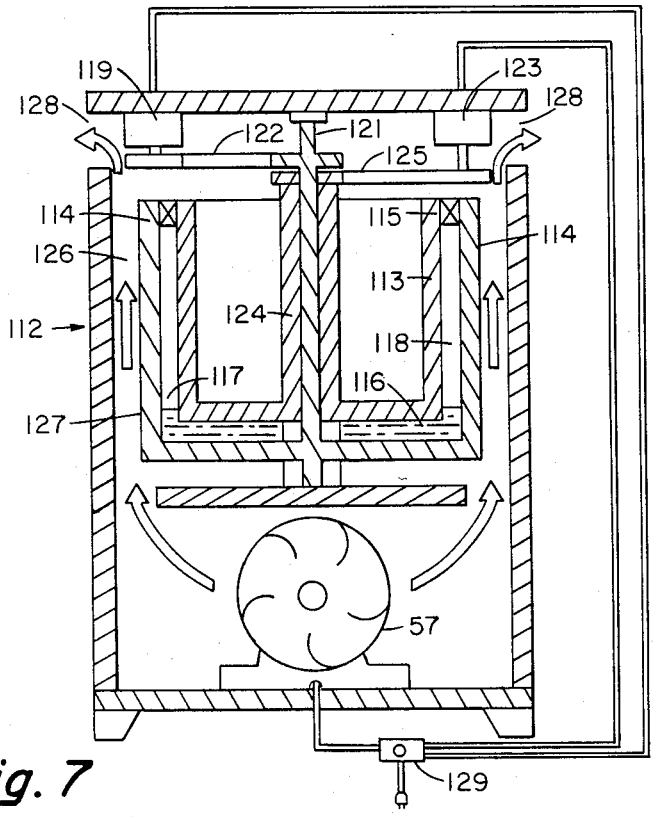
Fig. 7

METHOD AND APPARATUS FOR PRODUCING FRICTION HEAT

BACKGROUND OF THE INVENTION

This invention is an improvement over the invention disclosed in my U.S. Pat. No. 4,143,639 of Mar. No. 13, 1979 entitled Friction Heat Space Heater.

Prior to the invention disclosed in my said patent it had been known to provide what I call "flow through fluid" heaters which usually consisted of a set of discs rotating under power in vertical planes on a horizontal shaft axis, within a housing, the housing having a liquid inlet and a liquid outlet for heating liquid continually flowing therethrough by the friction of one disc on another.

Exemplary of such patents are U.S. Pat. No. 86,270 to Ball of Jan. 26, 1869 wherein the housing contains a rotor and stator with flat vertical interface and horizontal shaft for heating flow through of air. Also U.S. Pat. No. 4,004,553 to Stenstrom of Jan. 25, 1977 wherein a cup shaped rotor has truncated conical interfaces within a correspondingly shaped solid stator and a horizontal shaft for heating flow through of liquid.

An abandoned patent application to Beldimano, U.S. Ser. No. 326,790 published May 11, 1943 discloses a horizontal shaft rotor within a vaned stator for heating flow through liquid, there being oil filling the rotor chamber. U.S. Pat. No. 2,251,344 to Tesch of Aug. 5, 1941 discloses a drum rotating on a horizontal axis between horizontal friction shoes and in a chamber full of oil for heating flow through liquid.

None of the above patents teach inner and outer friction drums mounted to rotate on a vertical axis, all teach the flow through of a fluid and none teach the use of a small, captive, quantity of oil, only slightly filling the annular rotor chamber, to transfer friction heat between members during rotation.

A French Pat. No. 760,213 of Feb. 19, 1934 to Marical, departs from the horizontal shaft, disc type, friction heater concept of the above patents by heating flow through liquid in the space between inner and outer truncated conical members, the inner member being rotatable on a vertical axis.

However, unlike the elongated cylindrical drums of my said patent wherein the inner drum rotates on a vertical axis within the outer drum, there is no captive supply of oil in the annular space of Marical and there is no air chamber, outside the outer member, to heat air as it is circulated through the air chamber.

SUMMARY OF THE INVENTION

In this invention an inner member and an outer member are mounted for rotation of one relative to the other on a common vertical axis, within a housing, there being an outer annular air chamber around the outer member and an outer annular liquid chamber between the upstanding side walls of the members as in my said patent. A small quantity of light oil is arranged to rise into the outer annular liquid chamber during rotation to transfer heat between the side walls of the members which are preferably about one eighth of an inch apart.

In all of the prior art known to me, and in my prior patent, the motor for rotating the rotative member is outside the confines of the members and is sometimes outside the housing of the heater.

In this invention, however, the inner member and the outer member are both of cup shaped configuration, and preferably of inverted cup shaped configuration to provide a central, axially extending space which accommodates the electric motor drive for the rotative member. By this construction, an inner annular liquid chamber is produced between the inner member side wall and the outer member inner wall.

In addition, by providing an inner upstanding wall on the housing, spaced from, and within the inner wall of the outer member an inner annular air chamber is produced.

In the preferred inverted cup shaped configuration of the inner and outer members therefore, the fan, or blower, draws cool ambient air into a housing inlet, thence along the central axially extending space in which the electric motor is mounted to cool the motor and pick up its heat. The motor heated air is then guided in the reverse direction along the inner annular air chamber to pick up heat from the friction heated inner wall of the outer member. The heated air is then guided in the reverse direction along the outer annular air chamber to pick up heat from the friction heated outer wall of the outer member and thence to the heated air outlet of the housing.

In this invention also, the housing side wall and the housing top wall are both formed with a substantial thickness of heat insulative material to deaden any sound and so that the housing can be touched without imparting discomfort or burns. The inner member and the outer member are both formed of relatively thick, heavy, heat-conductive and heat-retentive metal so that they continue to emit heat from a substantial period after each rotation cycle ceases. Such heavy metal, wherein the inverted cup shaped members may weigh three or four hundred pounds also prevents bulging of the rotating members under centrifugal force into an elliptical cross section which might cause touching and scraping of the members.

The heavy metal, cup shaped inner and outer members when supported only by the motor bearings and at only one end of the vertical axis of rotation, without bearings at the opposite end, are preferably only about twelve to fifteen inches in depth to also prevent vibration, or touching of the respective side walls during rotation, which is usually at about 1800 RPM.

BRIEF DESCRIPTION OF THE DRAWING

FIG. 5 is a view similar to FIG. 1 and FIG. 3 of another embodiment of the invention;

FIG. 6 is a top plan view in section on line 5—5 of FIG. 5;

FIG. 7 is a view similar to FIGS. 1, 3 and 5 of an embodiment of the invention in which the inner and outer members are cup shaped, but not inverted.

DESCRIPTION OF A PREFERRED EMBODIMENT

Figure 1:
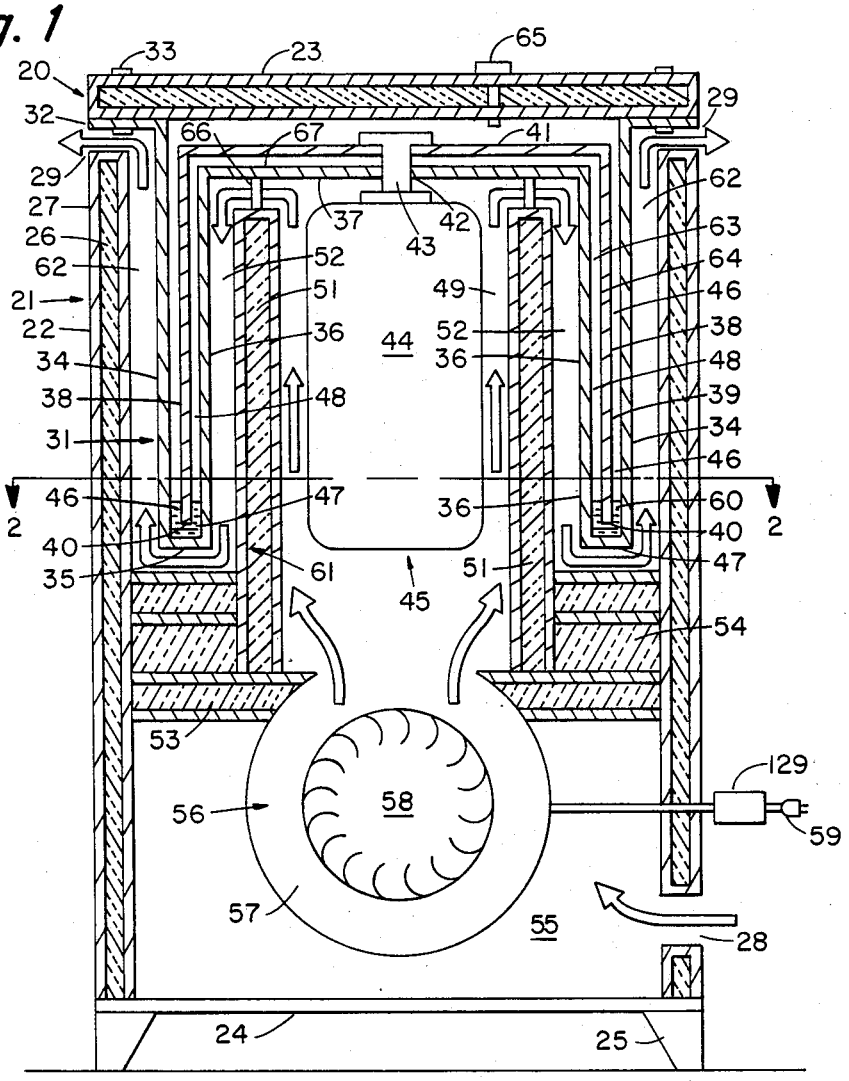
FIG. 1 is a side elevation in half section of a friction heater constructed in accordance with the invention.
Figure 2:
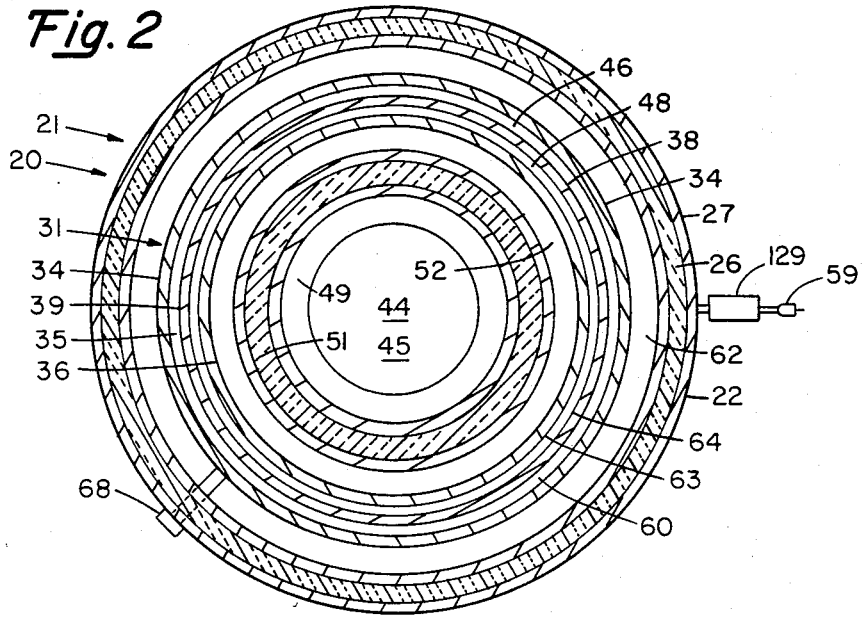
FIG. 2 is a top plan view in section on line 2—2 of FIG. 1.

In FIGS. 1 and 2 a preferred embodiment of the friction heater 20 of the invention is shown, the heater 20 having a housing 21 with an upstanding side wall 22, a top wall 23, a bottom, or base 24 and legs such as at 25.

The upstanding side wall 22, may be of cubical, or cylindrical, configuration and is provided with heat insulation 26, as is the top wall 23, so that the exterior face 27 of the heater is cool to the touch. A cool air inlet 28 and a heated air outlet 29 is provided in housing 21. The insulation 26 not only prevents heat from conduction through the walls 22 and 23 but also serves as sound insulation to quiet any noise of rotation to the minimum.

An outer member 31 is mounted within housing 21, which preferably is of inverted cup shaped configuration, with an attachment flange 32, fastened by bolts 33 to top wall 23, and a generally cylindrical, upstanding, outer, side wall 34 preferably about fifteen inches in height. The outer member 31, also includes an annular, integral bottom wall 35, an upstanding generally cylindrical, integral, inner wall 36 and a horizontal disc like, annular upper wall 37 to define the above mentioned inverted cup shaped configuration.

The inner member 38 is mounted within the outer member 31 and is also preferably of inverted, cup-shaped configuration with an upstanding, generally cylindrical side wall 39 spaced about one eighth of an inch from the outer side wall 34, and about one eighth of an inch from the inner side wall 36 of the outer member 31. Inner member 38 includes an integral, annular top wall 41 having an opening 42 for receiving the shaft 43 of electric motor 44 of the electric motor drive means 45 of the heater 20. The lower peripheral rim 40 of the inner member 38 is spaced from the annular bottom wall 35 of the outer member about one eighth of an inch.

In a heater of about thirty inches in height, the outer side wall 34 of outer member 31 is preferably about twenty two inches in diameter and about fifteen inches in height with the inner member side wall, and inner side wall of the outer member, spaced apart about one eighth of an inch to form an annular outer liquid chamber 46 of uniform, close clearance, a shallow annular lower liquid chamber 47 and an annular inner liquid chamber 48 also of uniform close clearance.

Because of the preferred, inverted, cup shaped configuration of the inner member 38 and the outer member 31, a central axially extending space 49 is provided for accommodating and receiving the electric motor 44, thereby providing a compact heater. The inner and outer members are preferably of heavy material, the rotating inner member being of one-quarter inch metal and the outer member being also of substantial thickness to prevent bulging of the inner side wall under rotation at the preferred speed of about 1800 RPM while also retaining and conducting heat for a substantial period after rotational friction ceases.

The term "generally cylindrical" is used to describe the upstanding side walls of the inner and outer members because it would be possible to make them slightly truncated conical if desired. It would also be possible to mount the outer member for rotation around a stationary inner member, or to rotate the inner and outer members in opposite angular directions, but cylindrical side walls with the inner member rotating within the outer member on the vertical axis of the shaft 43 of motor 44 is the preferred construction.

The housing 21 includes an upstanding, generally cylindrical inner side wall 51, within and spaced from the inner wall 36 of outer member 31 to form an inner, annular air chamber 52. Side wall 51 is supported by a horizontal annular partition 53 insulated at 54, the partition 53 being supported by housing side wall 22 and forming a lower compartment 55 for powered air circulation means 56 which is preferably a fan, or blower, 57 driven by electric motor 58 from the source of electricity 59.

It will be seen that cool air from the ambient atmosphere is drawn into the cool air inlet 28 by the blower 57 and circulated in the flow path represented by the hollow arrows past the electric motor 44 in the central axially extending space 49 to cool the motor while picking up heat. The so heated air then reverses direction in the inner annular air chamber 52 to pick up heat from the inner side wall 36, the housing inner side wall 51 acting as the air guide means 61. The heated air then again reverses direction to flow along the outer annular air chamber 62 and thence is discharged from heated air outlets 29.

As in my said patent, a small supply of light oil 60 is normally located in the shallow annular liquid chamber 47, but rises into the outer annular liquid chamber 46 during rotation of the inner member 38 to transfer heat from one member to the other to create frictional heat. It is believed that some of the oil, probably in emulsion form also transfers heat to the inner wall 36 of the outer member during rotation, this wall also becoming heated by conduction of the heavy heat conductive metal.

It should be noted that the supply of oil 60 is captive within the liquid chamber and only partially fills the same so that there is no "flow through" of liquid and the liquid compartments are not full of liquid.

The interior face of the upstanding side wall 39 of the inner member 38 is designated 63, the exterior face thereof is designated 64 and a cap 65 is provided to initially provide a charge of oil 63 in chamber 43, or to replace the same if it becomes slightly depleted after much use.

An apertured ring 66 is affixed to the upper rim of inner side wall 51 of housing 21 to support the partition 67 which in turn supports motor 44 in depending position, while the apertures in the ring 66 permit unimpeded passage of air in the flow path indicated. Motor 44 is preferably a commercially available three horse power electric motor, of the gear motor type rated for about 1725 RPM and about fifteen inches in depth and eight inches in diameter. A drain 68 may also be provided if desired.

Figure 3:
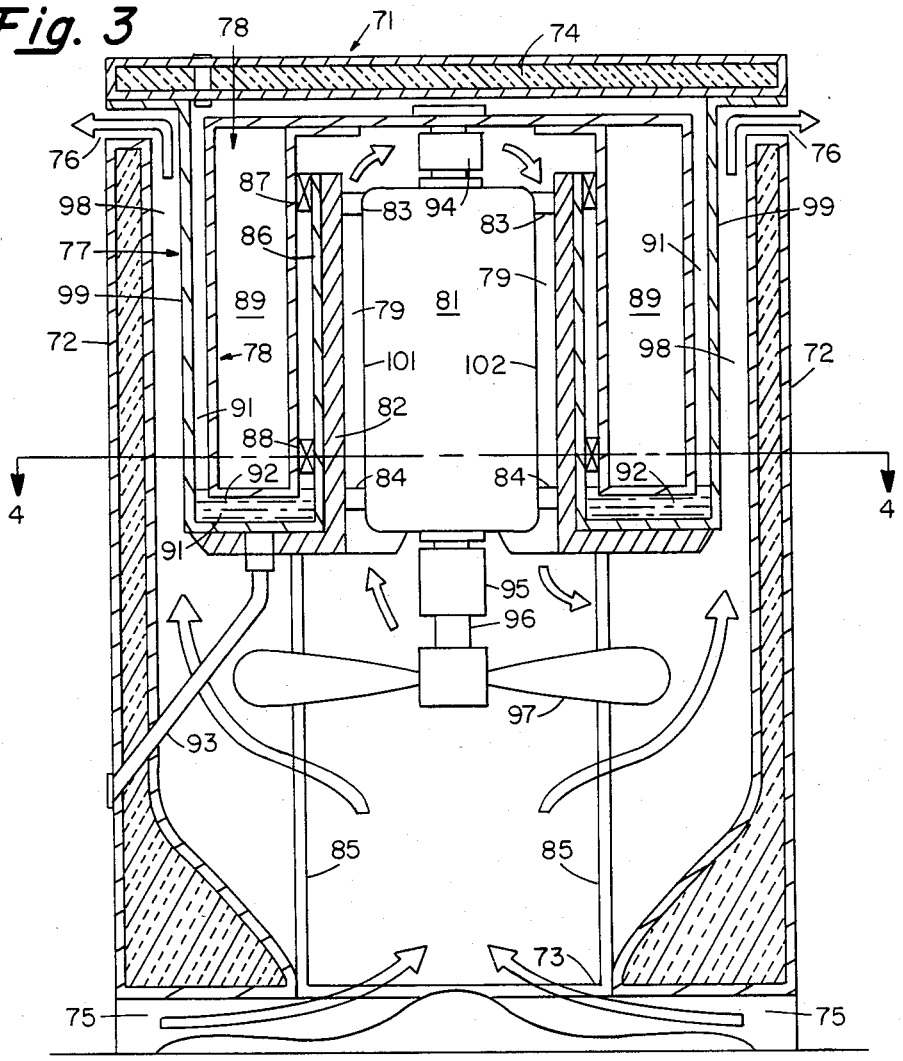
FIG. 3 is a view similar to FIG. 1 of another embodiment of the invention.
Figure 4:
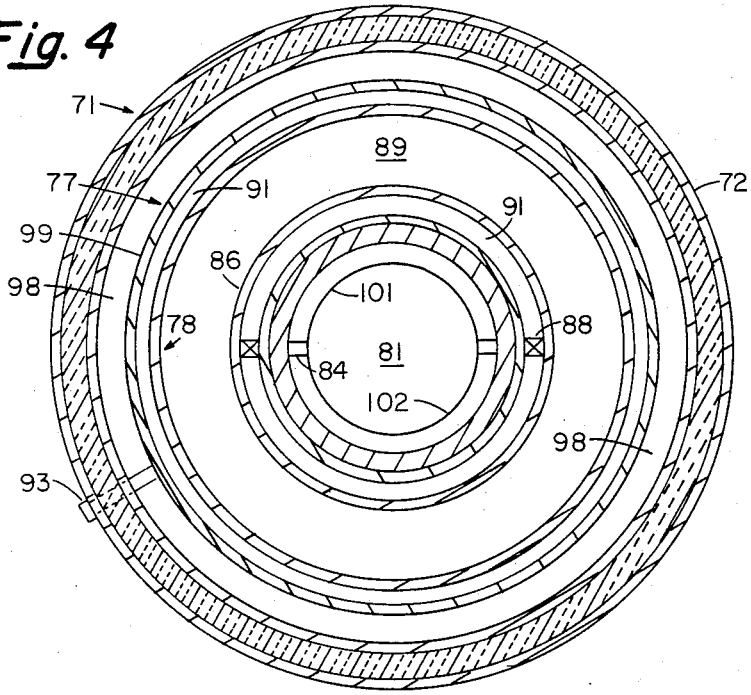
FIG. 4 is a top plan view in section on line 4—4 of FIG. 3.

Another embodiment of the invention is shown in FIGS. 3 and 4, the housing 71 having a heat insulated side wall 72, floor 73, top wall 74, cool air inlets 75 and heated air outlet 76.

The outer member 77 and the inner member 78 are both of inverted, cup shaped configuration to form the central axially extending space 79 for the electric motor 81. Motor 81 is supported by the inner side wall 82 by the inward projecting lugs 83 and 84, the side wall 82 being supported on vertical, spaced posts 85 from the floor 73. Outer member 77 has an inner upstanding wall 86 which supports upper bushings 87 and lower bushings 88 for rotatably engaging the inner member 78. The inner member 78 is hollow with an inner sealed chamber 89 so that a shallow, annular liquid chamber 91, of considerable width is provided for the oil 92. A drain 93 is provided and the motor 81 is equipped with a magnetic clutch 94 connecting it to the inner member 78 and a second magnetic clutch 95 on the motor shaft 96, connected to a fan 97.

In this embodiment the flow path, indicated by hollow arrows, leads from the cool air inlets 75 up the annular air chamber 98 and out of the heated air outlets 76 picking up heat from the exterior face 99 of the side wall of the outer member. It also leads up the central air space 79, on one side 101 of the motor 81 and down the other side 102 thereof to cool the motor while picking up heat therefrom, the motor being cooled thereby while the air heated by the motor joins the flow path.

Another embodiment of the invention is shown in FIGS. 5 and 6 wherein the inner member 103 and the outer member 104 are both of inverted, cupshaped configuration with the electric motor 105 in the central, axially extending space 106 but both members are open at their respective tops 107 and 108 so that air flows upwardly and unidirectionally past the motor 105 and past both the inner side 109 wall and the outer side wall 111 of the outer member 104.

Still another embodiment of the invention is illustrated diagramatically in FIG. 7 wherein the heater housing 112, is insulated and cool to the touch, the inner member 113 and the outer member 114 are of cup shaped configuration with an upper bushing 115 therebetween and a small supply of oil 116 in the shallow liquid chamber 117 ready to rise into the annular liquid chamber 118 upon rotation. An electric motor 119, rotates the outer member 114, on its central shaft 121, by belt and pulley power transmission 122, in one angular direction while an electric motor 123 rotates the inner member 113, on its shaft 124, sleeved on shaft 121, by belt and pulley power transmission 125 and in the opposite angular direction.

The electric motor powered air blower 57 directs ambient cool air up the annular air chamber 126, along the exterior face 127 of the outer member 114 and out of the air outlets 128 back into the ambient atmosphere.

In each of the embodiments of my invention suitable thermostatic control circuits 129 are provided, to cause the rotating member to generate friction heat until a desired temperature is reached, the control circuit then halting rotation while causing the electric motor powered air circulation means to continue to circulate air past the friction heated surfaces until temperature drops to a predetermined figure for a recommencement of the heating cycle. This circuitry and control system is explained in my above mentioned U.S. Patent and therefore is not explained in detail in this application.

I claim:

1. Heat generating apparatus, comprising:

(a) a housing formed with an air inlet opening and an air outlet opening spaced from one another;

(b) a relatively fixed cylindrical casing mounted upright in said housing and formed with spaced cylindrical concentric inner and outer walls open at the upper end thereof, and closed at the lower end thereof to define at least one relatively deep annular well at the lower portion thereof for containing a quantity of lubricating liquid therein;

(c) a cylindrical rotor mounted in said casing for rotation about a vertical axis;

(d) said rotor being formed with a cylindrical tubular lower skirt extending concentrically into said well and defining a pair of relatively small annular inner and outer clearances with said inner and outer walls of said casing;

(e) said rotor including a transverse wall;

(f) power means drivingly connected to said transverse wall for rotating said rotor about said vertical axis whereby said liquid will move upwardly in both of said clearances and cause said walls to be heated; and (g) air moving means operatively associated with said apparatus for flowing air against the outer surface of said walls between said inlet and outlet openings.

* * * * *